US012624537B1

(12) United States Patent
Perrine

(10) Patent No.: US 12,624,537 B1
(45) Date of Patent: May 12, 2026

(54) AUTOMATIC AND HANDS-FREE TOILET DEODORIZER AND CLEANER

(71) Applicant: Patrick Howard Perrine, Austin, TX (US)

(72) Inventor: Patrick Howard Perrine, Austin, TX (US)

( * ) Notice: Subject to any disclaimer, the term of this patent is extended or adjusted under 35 U.S.C. 154(b) by 251 days.

(21) Appl. No.: 18/219,839

(22) Filed: Jul. 10, 2023

Related U.S. Application Data

(60) Provisional application No. 63/389,011, filed on Jul. 14, 2022.

(51) Int. Cl.
*E03D 9/00* (2006.01)

(52) U.S. Cl.
CPC ..... *E03D 9/005* (2013.01)

(58) Field of Classification Search
CPC ..... E03D 9/005; E03D 9/032
See application file for complete search history.

(56) References Cited

U.S. PATENT DOCUMENTS 6,029,286 A * 2/2000 Funk ..... E03D 9/005 4/223
10,494,803 B2 * 12/2019 Sonovani ..... E03D 9/02
2009/0000016 A1 * 1/2009 Sawalski ..... E03D 9/032 4/223
2010/0205730 A1 * 8/2010 Muhlhausen ..... E03D 9/032 4/223
2012/0110722 A1 * 5/2012 Abbondanzio ..... E03D 9/033 4/223
2013/0026250 A1 * 1/2013 Burt ..... B05B 17/0615 239/302
2023/0086582 A1 * 3/2023 Johnson ..... F21V 23/0464 4/228.1

FOREIGN PATENT DOCUMENTS

ES 2661214 T3 * 3/2018 ..... E03D 9/032

* cited by examiner

*Primary Examiner* — Erin Deery
(74) *Attorney, Agent, or Firm* — Plager Schack LLP; Mark H. Plager; Alexis Saenz

(57) ABSTRACT

An automatic and hands-free toilet deodorizer and cleaner system that attaches to a toilet bowl rim and includes compartments to hold fluids for the dispensing of deodorizer and cleaner into the interior of a toilet bowl. Sensors may detect the use of the toilet triggering automatic dispensing. In another embodiment, the dispensing of fluids is done by an automatic timer. The nozzles may include atomizers to distribute the fluids more evenly around the bowl and avoid clogging. The angle of the nozzles may be in a range of 62-66 degrees relative to a horizontal plane to provide optimal spray coverage into the bowl interior.

9 Claims, 4 Drawing Sheets

AUTOMATIC AND HANDS-FREE TOILET DEODORIZER AND CLEANER

CROSS REFERENCE TO RELATED APPLICATIONS

This application claims benefit under 35 U.S.C. § 119 (e) of U.S. Provisional Application having Ser. No. 63/389,011 filed Jul. 14, 2022, which are hereby incorporated by reference in its entirety.

BACKGROUND

The embodiments herein relate generally to disinfectant systems, and more particularly, to an automatic and hands-free toilet deodorizer and cleaner system.

Toilets are used frequently throughout the day and often by multiple people causing unpleasant smells and dirty toilets. Household and publicly shared toilets are often not cleaned regularly.

Some products address either deodorizing or cleaning. Typically, they require refilling and use a difficult refill design. Some products in the market require the use of specific brand bottles of liquid. Some products have too many manual moving parts that encourage breakages such as the activation button and the replacement bottle so that the product lifecycle is short and product repurchase is encouraged. Some devices only hold one liquid solution and require manual activation.

SUMMARY

In an embodiment of the disclosure, an automatic and hands-free toilet deodorizer and cleaner system includes a housing and a controller. A first reservoir and second are coupled to the controller. A pump is coupled to the controller and to the first reservoir and the second reservoir. A first conduit is coupled to the first reservoir. A second conduit is coupled to the second reservoir. A first nozzle is coupled to the first conduit. A second nozzle is coupled to the second conduit. A first atomizer is positioned on a first outlet of the first nozzle. A second atomizer is positioned on a second outlet of the second nozzle. The controller is configured to operate the pump to move a cleaning fluid from the first reservoir, through the first conduit and out the first atomizer of the first nozzle, and the pump is configured to move a deodorizing fluid from the second reservoir, through the second conduit, and out the second atomizer of the second nozzle.

In another embodiment, an automatic and hands-free toilet deodorizer and cleaner system includes a housing and a controller. A first reservoir and second are coupled to the controller. A pump is coupled to the controller and to the first reservoir and the second reservoir. A first conduit is coupled to the first reservoir. A second conduit is coupled to the second reservoir. A first nozzle is coupled to the first conduit. A second nozzle is coupled to the second conduit. A bridge is coupled to the first conduit and to the second conduit. The bridge is disposed to rest on a rim of a toilet with the housing positioned on an exterior facing side of the rim and the first nozzle and the second nozzle are positioned on an interior side of the rim. A first outlet of the first nozzle is disposed to point down at an angle of 63.6 degrees from the bridge, into an interior of a bowl of the toilet. A second outlet of the second nozzle is disposed to point down at an angle of 63.6 degrees from the bridge, into the interior of the bowl of the toilet. The controller is configured to operate the pump to move a cleaning fluid from the first reservoir, through the first conduit and out the first nozzle, and the pump is configured to move a deodorizing fluid from the second reservoir, through the second conduit, and out the second nozzle.

BRIEF DESCRIPTION OF THE FIGURES

A detailed description of some embodiments of the invention is made below with reference to the accompanying figures, wherein like numerals represent corresponding parts of the figures.

DETAILED DESCRIPTION OF CERTAIN EMBODIMENTS

Figure 1:
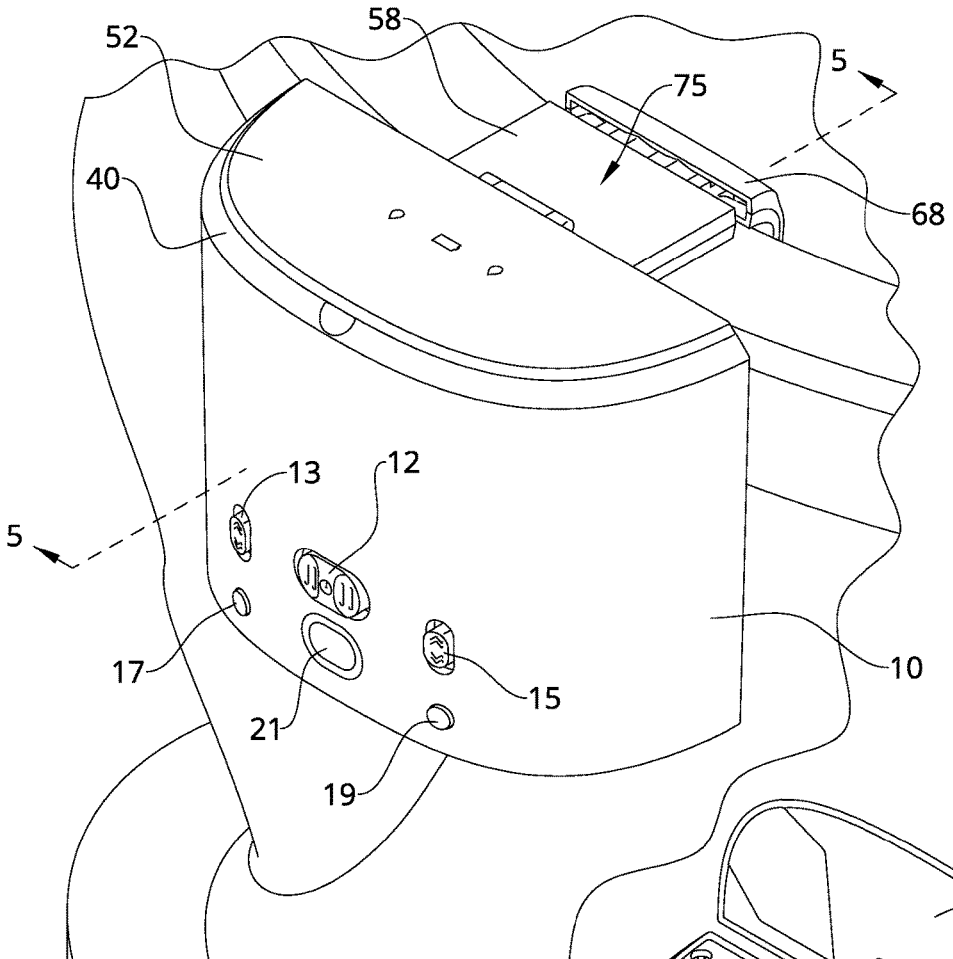
FIG. 1 is a partial perspective view of an automatic and hands-free toilet deodorizer and cleaner system attached to a toilet bowl according to an embodiment.
Figure 3:
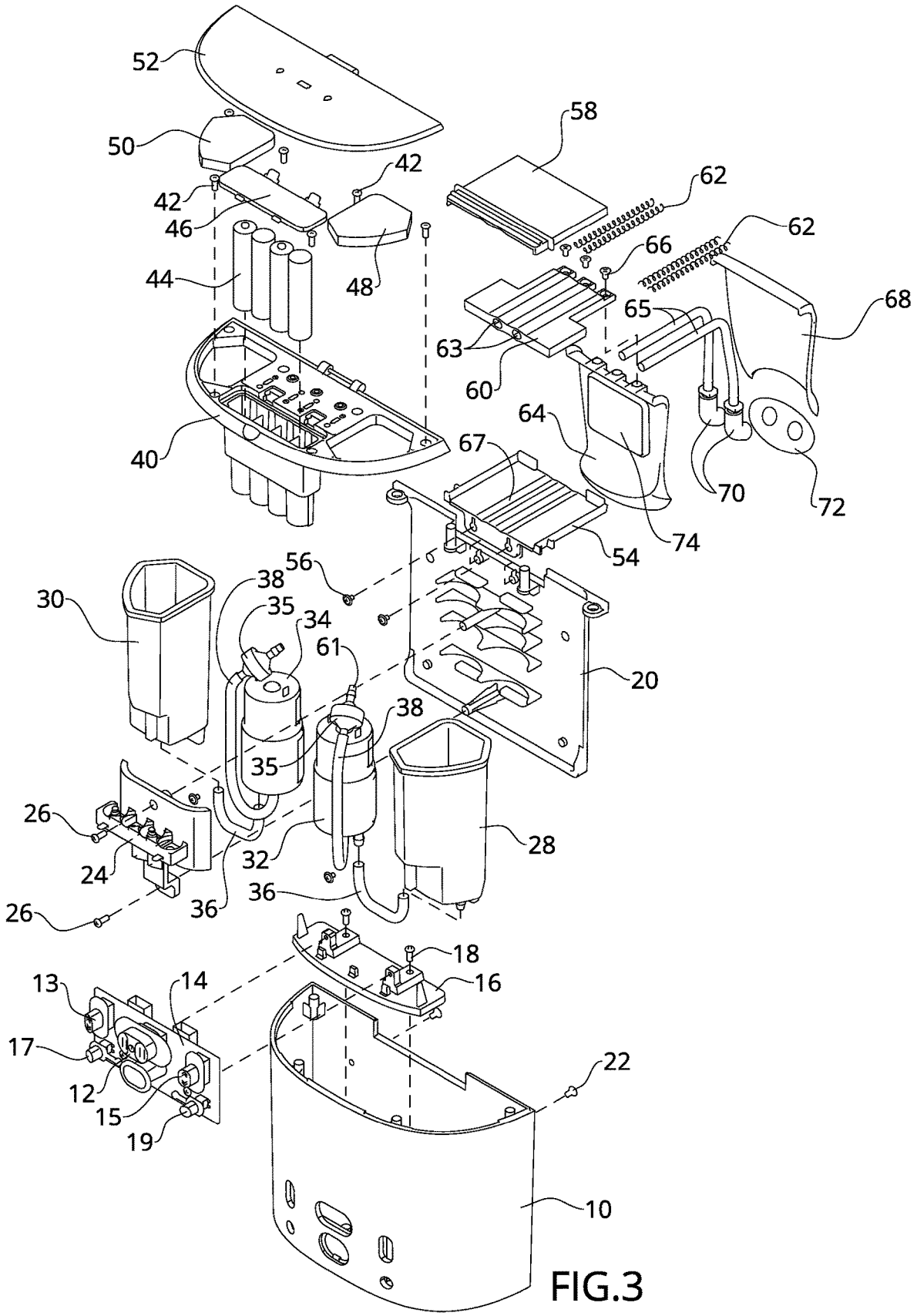
FIG. 3 is an exploded view of the system shown in FIG. 1.
Figure 4:
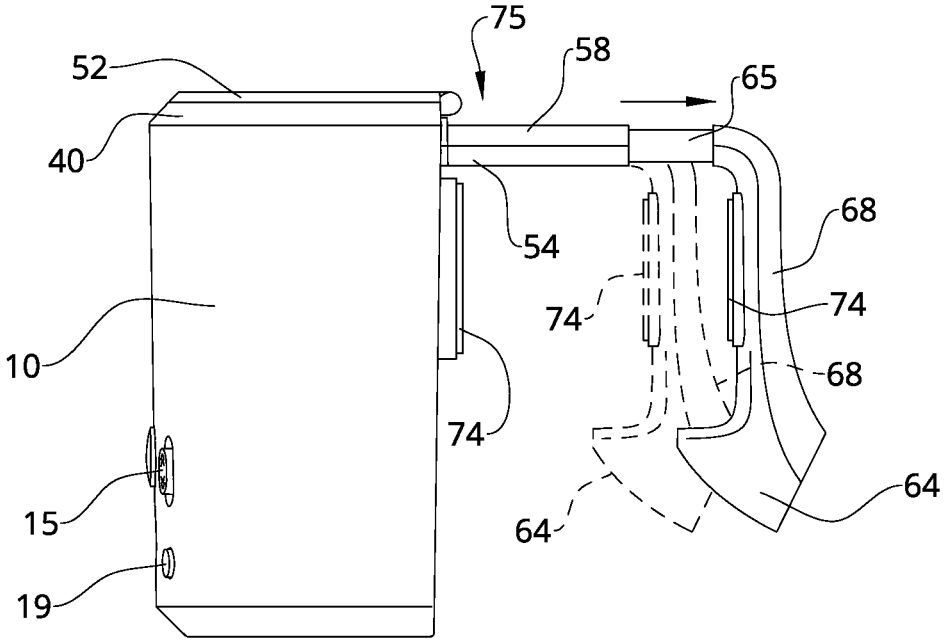
FIG. 4 is a side view of the system shown in FIG. 1.
Figure 5:
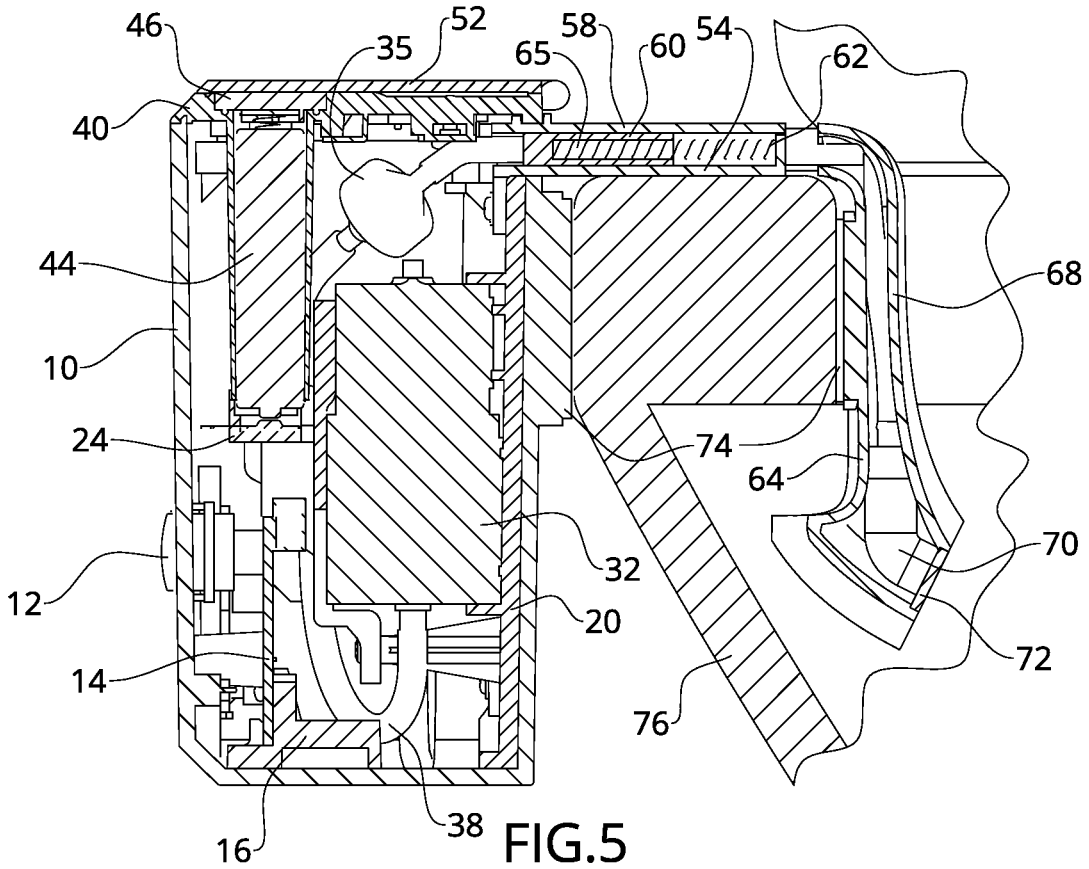
FIG. 5 is a cross-sectional view of the system shown in FIG. 4.

Broadly, embodiments provide an automatic and hands-free toilet deodorizer and cleaner system that can be seen in FIGS. 1-6. The system may be attached to the rim of a toilet bowl 76 (as shown in FIGS. 1 and 5). The system's operation may be triggered by an automatic timer that a user may set to dispense cleaner and/or deodorant at pre-set intervals. Dispensing nozzles are configured to spray fluid into the toilet bowl 76. See, for example, FIGS. 4-6. The subject apparatus is a dual-function device allowing two fluids or liquids and any combination of deodorizers and cleaners that can easily be filled while the device is installed on the toilet, along with access to batteries for easy replacement. The subject apparatus also includes an automatic timer and spraying function in addition to a manual feature to keep the toilet clean and fresh in between uses.

Figure 2:
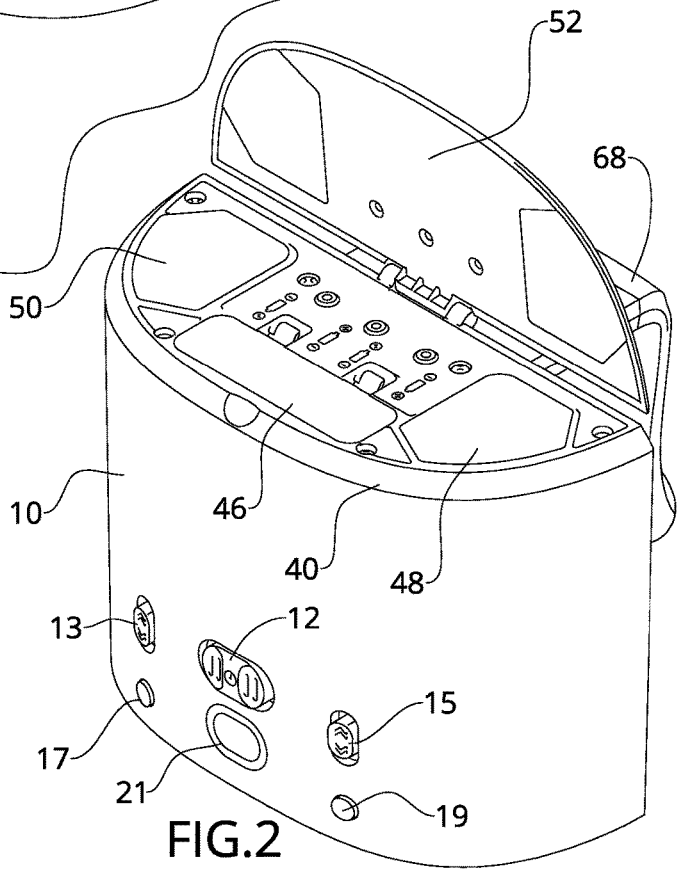
FIG. 2 is a perspective view of the system of FIG. 1 showing the housing open according to an embodiment.

FIGS. 1 and 2 show the system with emphasis on a housing 10 that faces an exterior side of the toilet bowl 76. On the exterior of housing 10, the system may include a rocker switch 12 that selects one of two reservoirs or tanks (one for a detergent cleaner and one for a deodorizer) that may operate the tanks when using a hands-free mode. In some embodiments, the system may include vertical slider switches 13 and 15 (one for each tank) that may control timers for respective tanks 28 or 30. The switches 13 and 15 may have pre-set intervals that control the frequency at which a fluid in each tank is dispensed. Some embodiments include a manual push button 17 and manual push button 19 (one for each tank). The push buttons 17 and 19 may trigger a manual operation of a spray function for each respective fluid of respective tanks. Some embodiments may include a sensor 21 that operates a hands-free operation of the spray for whichever tank is currently selected by the rocker switch 12. The sensor 21 may be for example, an infrared detector or other non-contact sensor. Sensor 21 may detect the use of the toilet triggering automatic dispensing of detergent or deodorizer from one of the reservoirs 28 and/or 30.

As is shown in FIG. 3, the controls 12 are coupled to a control board 14 that coordinates the functions in the system. Some embodiments include a bridge 75 coupled to a rear side of the housing 10 that is configured to sit across the top of the toilet bowl 76 rim and support mounting of the system to the toilet bowl. In some embodiments, the bridge 75 may be configured to operate as a spring-loaded hook. The housing 10 may include a top cover 40 that protects the internal components when a lid 52 on the top cover 40 is lifted up. One embodiment uses a top-fill design of refillable tanks/reservoirs 28 or 30. When the lid 52 is lifted, one can see a battery cover 46, a right-side reservoir cover 48 covering one of the refillable tanks/reservoirs 28, and a left side reservoir cover 50 covering the other refillable tank/reservoir 30, integrated into the cover 40.

FIG. 3 shows an internal configuration of components according to an embodiment. With respect to the electrical features, embodiments may include a support module 16 onto which the control board 14 is mounted via fasteners 18. Under the battery cover 46 is a battery compartment for one or more batteries 44. The battery cover 46, right-side reservoir cover 48, and a left side reservoir cover 50 may be fixed into place via fasteners 42.

Embodiments generally include a first reservoir 28 and a second reservoir 30. One reservoir may hold a cleaning agent fluid while the other reservoir may hold a deodorizer fluid. A first pump 32 is coupled to the first reservoir 28. A second pump 34 is coupled to the second reservoir 30. Some embodiments include hoses 36 that serve as conduits for fluids in the first reservoir 28 and the second reservoir 30 to the first pump 32 and second pump 34. Some embodiments may include a wall 20 for supporting mounting of the reservoirs 28 and 30, and the pumps 32 and 34. The support wall 20 may be positioned against the interior of the rear wall of the housing 10. Some embodiments may include a bracket panel 24 that supports the pumps 32 and 34 from the front side, to the support wall 20 (via fasteners 26). Fasteners 22 may secure the top cover 40 to the housing 10. The control board 14 controls when and how much of each fluid is dispensed from respective reservoirs 28 and 30. The schedule of dispensing may occur simultaneously or independently for each reservoir 28 and 30. It will be understood that the fluids may be held interchangeably in the respective reservoirs 28 and 30.

Some embodiments may include hoses 38 that carry the fluids from the pumps 32 and 34 to filters 35. The filters 35 at the ends of the hoses 38 may include spigots 61 connect into pipes 65. The pipes 65 may include a first section that may be essentially horizontal, and a second portion that projects downward (after a bend) at an angle from the first portion. The ends of the pipes 65 may connect to first and second nozzles 70.

Some embodiments may include a telescopic configuration for the pipes 65 so that the position of the nozzles 70 within the bowl interior may be adjusted along a horizontal plane. In one embodiment, the pipes 65 may be routed into tunnels 63 of a plate 60. The plate 60 may be configured to slide inside the bridge 75. The bridge 75 may include a lower bracket 54 and an upper bracket 58. The plate 60 may include a tunnel 63 for each pipe 65 to travel through.

The ends of the hoses 38 may be disconnected from the pipes 65 so that the fluid from each reservoir 28 and 30 exits the ends of hoses 38 and passes temporarily into the tunnels 63 before entering the pipes 65. The tunnels 63 may define a circular protuberance on at least the bottom side of the plate 60. The lower bracket 54 may include semi-circular channels 67 configured to receive the protuberances of the plate 60. The pipes 65 may be fixed to the plate 60 by fasteners 66. When the user wants to pull the nozzles 70 further into the bowl interior (or push them back inward), the user may grasp the arm 68 and push or pull so that the pipes 65 move the plate 60 inward or outward along the channels 67. See FIG. 4 for an illustration of the telescopic action of the nozzle mechanism.

Some embodiments include springs 62 that are a tightening mechanism to secure the housing 10 to the toilet bowl 76. The springs 62 allow the hook to be pulled away from the main body unit, allowing the "arm" to extend to fit wider toilet bowl rims. The springs work to "pull" the arm/hook to be tight against the toilet bowl rim. This is the function that makes this product universally fit all toilet bowl rims. The springs are the tightening mechanism.

Figure 6:
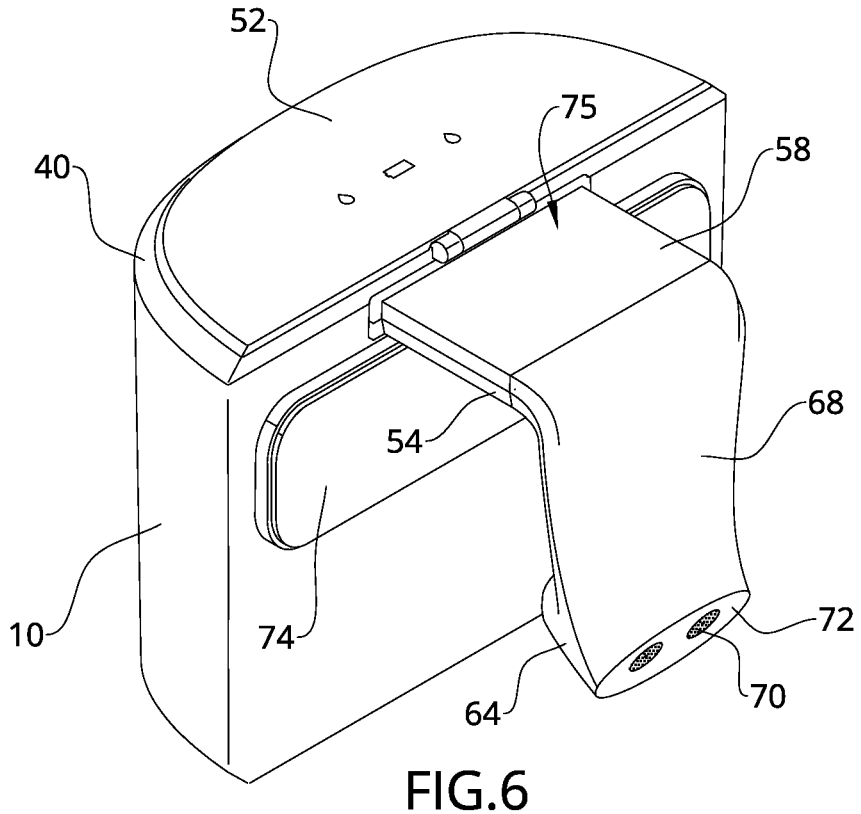
FIG. 6 is a perspective rear view of the system shown in FIG. 1.

Referring now to FIGS. 4-6, details of the nozzle mechanism are shown. The nozzles 70 may be housed inside an arm 68 that bends downward at an angle from the plane of the upper bracket 58 of the bridge 75. The nozzles 70 may be encased inside an outlet end 64 of the arm 68. As can be seen best in FIG. 5, the angle of dispensing for each nozzle 70 is approximately in the range of 62-66 degrees relative to the horizontal plane of the bridge 75 or the toilet bowl rim. In one embodiment, the nozzles 70 may be set to 63.6 degrees for optimal of the surface area in the bowl's interior. This angle (or range of angles) provides a better coverage down into the bowl interior's surface. In some embodiments, the nozzle heads may include an atomizer (for example, a plurality of holes in a grid pattern in a faceplate) that disperses the fluids (cleaning agent and deodorizer) in a fine mist into the interior of the bowl 76. As may be appreciated, the atomizer feature provides a wider and more even distribution of the fluids within the bowl interior. The effect of the atomizer improves on the coverage available for reaching a greater area of the bowl. In addition, the density of the holes in the atomizer prevents clogging of the nozzles 70 given the viscosity of cleaning agents and some deodorizer fluids.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An automatic and hands-free toilet deodorizer and cleaner system comprising:

a housing;

a controller coupled to the housing;

a first reservoir coupled to the controller;

a second reservoir coupled to the controller;

a first slider switch coupled to the controller;

a second slider switch coupled to the controller;

a first pump coupled to the controller and to the first reservoir;

a second pump coupled to the controller and to the second reservoir;

a first conduit coupled to the first reservoir;

a second conduit coupled to the second reservoir;

a first nozzle coupled to the first conduit;

a second nozzle coupled to the second conduit;

a first atomizer positioned on a first outlet of the first nozzle; and a second atomizer positioned on a second outlet of the second nozzle, wherein the controller is configured to:

operate the first pump and the second pump, wherein the first pump is configured to move a cleaning fluid from the first reservoir, through the first conduit and out the first atomizer of the first nozzle, the second pump is configured to move a deodorizing fluid from the second reservoir, through the second conduit, and out the second atomizer of the second nozzle, the first slider switch is configured to control, via the controller, a first frequency of dispense of the cleaning fluid at first pre-set intervals from the first reservoir, the second slider switch is configured to control, via the controller, a second frequency of dispense of the deodorizing fluid at second pre-set intervals from the second reservoir, wherein control of the dispensing of the cleaning fluid is independent of control of the deodorizing fluid; and release the cleaning fluid from the first nozzle simultaneously with release of the deodorizing fluid from the second nozzle.

2. The system of claim 1, wherein the first atomizer and the second atomizer each include a plurality of holes.

3. The system of claim 2, wherein the plurality of holes are disposed in a grid pattern.

4. The system of claim 1, further comprising a bridge coupled between the housing and the first nozzle and the second nozzle, and wherein the bridge is disposed to rest on a rim of a toilet with the housing positioned on an exterior facing side of the rim and the first nozzle and the second nozzle are positioned on an interior side of the rim.

5. The system of claim 4, further comprising a plate housed inside the bridge, wherein the plate is configured to telescope in and out of the bridge.

6. An automatic and hands-free toilet deodorizer and cleaner system, comprising:

a housing;

a controller coupled to the housing;

a first reservoir coupled to the controller;

a second reservoir coupled to the controller;

a first pump coupled to the controller and to the first reservoir;

a second pump coupled to the controller and to the second reservoir;

a first conduit coupled to the first reservoir;

a second conduit coupled to the second reservoir;

a first nozzle coupled to the first conduit;

a second nozzle coupled to the second conduit;

a bridge coupled to the first conduit and to the second conduit, wherein the bridge is disposed to rest on a rim of a toilet with the housing positioned on an exterior facing side of the rim and the first nozzle and the second nozzle are positioned on an interior side of the rim;

a first outlet of the first nozzle, wherein the first outlet is disposed to point down at an angle of 63.6 degrees from the bridge, into an interior of a bowl of the toilet; and a second outlet of the second nozzle, wherein the second outlet is disposed to point down at an angle of 63.6 degrees from the bridge, into the interior of the bowl of the toilet; and a rocker switch coupled to the controller, configured to move between a first state and a second state, wherein the controller is configured to operate one of either the first pump or the second pump based on a position of the rocker switch in either the first state or the second state, the first pump is configured to move a cleaning fluid from the first reservoir, through the first conduit and out the first nozzle, and the second pump is configured to move a deodorizing fluid from the second reservoir, through the second conduit, and out the second nozzle.

7. The system of claim 6, further comprising one or more arms coupled to the first nozzle and the second nozzle, wherein the one or more arms are configured to telescope.

8. The system of claim 6, wherein the bridge is spring-loaded.

9. The system of claim 6, further comprising a sensor coupled to the controller wherein the sensor is configured to detect a user and operate at least one of the first pump or the second pump to dispense at least one of the cleaning fluid or the deodorizing fluid.

* * * * *